US007546970B2

(12) United States Patent
McNeil et al.

(10) Patent No.: US 7,546,970 B2
(45) Date of Patent: Jun. 16, 2009

(54) PROCESS FOR WINDING A WEB MATERIAL

(75) Inventors: Kevin Benson McNeil, Loveland, OH (US); Jeffrey Moss Vaughn, Cincinnati, OH (US); Michael James Gworek, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 434 days.

(21) Appl. No.: 11/267,201

(22) Filed: Nov. 4, 2005

(65) Prior Publication Data

US 2007/0102560 A1 May 10, 2007

(51) Int. Cl.
*B65H 19/22* (2006.01)

(52) U.S. Cl. ..... 242/533.4; 242/533.5; 242/533.6; 242/541.4; 242/542.1

(58) Field of Classification Search ..... 242/533.4, 242/542.1, 541.4, 533.5, 533.6, 526.1
See application file for complete search history.

(56) References Cited

U.S. PATENT DOCUMENTS

| | | | | |
|---|---|---|---|---|
| 1,040,188 | A | 10/1912 | Gray | |
| 2,769,600 | A | 11/1956 | Kwitek et al. | |
| 3,472,462 | A * | 10/1969 | Young | 242/523.1 |
| 3,630,462 | A | 12/1971 | Nordgren et al. | |
| 3,697,010 | A | 10/1972 | Nystrand | |
| 3,784,122 | A * | 1/1974 | Kataoka | 242/525.7 |
| 3,791,602 | A | 2/1974 | Isakson | |
| 3,885,749 | A * | 5/1975 | Skacel | 242/420 |
| 4,139,166 | A * | 2/1979 | Powell et al. | 242/542.1 |
| 4,343,440 | A * | 8/1982 | Engl | 242/547 |
| 4,422,588 | A | 12/1983 | Nowisch | |
| 4,431,140 | A | 2/1984 | Tetro | |
| 4,541,583 | A * | 9/1985 | Forman et al. | 242/527.3 |
| 4,588,138 | A | 5/1986 | Spencer | |
| 4,682,153 | A | 7/1987 | Boozer et al. | |
| 4,715,552 | A * | 12/1987 | Matsumoto | 242/527.5 |
| 4,723,724 | A | 2/1988 | Bradley | |
| 4,798,350 | A | 1/1989 | Jorgensen et al. | |
| 4,811,915 | A | 3/1989 | Smith | |
| 4,828,195 | A | 5/1989 | Hertel et al. | |
| 4,856,752 | A | 8/1989 | Linn | |
| 4,909,452 | A | 3/1990 | Hertel et al. | |
| 4,919,351 | A | 4/1990 | McNeil | |
| 4,955,554 | A | 9/1990 | LeBoeuf et al. | |
| 4,962,897 | A | 10/1990 | Bradley | |
| 4,993,652 | A | 2/1991 | Moeller | |
| 5,104,055 | A | 4/1992 | Buxton | |
| 5,104,155 | A | 4/1992 | Kirkwood | |

(Continued)

FOREIGN PATENT DOCUMENTS

| | | |
|---|---|---|
| EP | 0 291 767 | 11/1988 |

(Continued)

*Primary Examiner*—Peter M Cuomo
*Assistant Examiner*—Juan J Campos
(74) *Attorney, Agent, or Firm*—Peter D. Meyer

(57) ABSTRACT

A method for rewinding a web material is disclosed. The method provides for the steps of (1) Disposing the web material on a first surface contact roll, (2) Providing at least one winding spindle proximate the material disposed upon the first surface contact roll, (3) Adjusting the first surface contact roll relative to the at least one winding spindle, and, (4) Transferring the web material to the at least one winding spindle from the first surface contact roll.

20 Claims, 6 Drawing Sheets

U.S. PATENT DOCUMENTS

| | | | | |
|---|---|---|---|---|
| 5,137,225 | A | 8/1992 | Biagiotti | |
| 5,190,232 | A * | 3/1993 | Brandon et al. | 242/533.4 |
| 5,226,611 | A | 7/1993 | Butterworth et al. | |
| 5,267,703 | A | 12/1993 | Biagiotti | |
| 5,285,979 | A | 2/1994 | Francesco | |
| 5,312,059 | A | 5/1994 | Membrino | |
| 5,335,869 | A | 8/1994 | Yamaguchi et al. | |
| 5,368,252 | A | 11/1994 | Biagiotti | |
| 5,370,335 | A | 12/1994 | Vigneau | |
| 5,402,960 | A | 4/1995 | Oliver et al. | |
| 5,431,357 | A | 7/1995 | Ruegg | |
| 5,497,959 | A | 3/1996 | Johnson et al. | |
| 5,505,405 | A | 4/1996 | Vigneau | |
| 5,538,199 | A | 7/1996 | Biagiotti | |
| 5,542,622 | A | 8/1996 | Biagiotti | |
| 5,565,033 | A | 10/1996 | Gaynes et al. | |
| 5,603,467 | A | 2/1997 | Perini et al. | |
| 5,660,349 | A | 8/1997 | Miller et al. | |
| 5,660,350 | A | 8/1997 | Byrne et al. | |
| 5,667,162 | A | 9/1997 | McNeil et al. | |
| 5,690,297 | A | 11/1997 | McNeil et al. | |
| 5,695,149 | A * | 12/1997 | Schulze et al. | 242/533.4 |
| 5,725,176 | A | 3/1998 | Vigneau | |
| 5,732,901 | A | 3/1998 | McNeil et al. | |
| 5,769,352 | A | 6/1998 | Biagiotti | |
| 5,772,149 | A | 6/1998 | Butterworth | |
| 5,779,180 | A | 7/1998 | Smedt et al. | |
| 5,810,282 | A | 9/1998 | McNeil et al. | |
| 5,839,680 | A | 11/1998 | Biagiotti | |
| 5,845,867 | A | 12/1998 | Hould et al. | |
| 5,899,404 | A | 5/1999 | McNeil et al. | |
| 5,909,856 | A | 6/1999 | Myer et al. | |
| 5,913,490 | A | 6/1999 | McNeil et al. | |
| 5,979,818 | A | 11/1999 | Perini et al. | |
| 6,000,657 | A | 12/1999 | Butterworth | |
| 6,056,229 | A | 5/2000 | Blume et al. | |
| 6,142,407 | A | 11/2000 | McNeil et al. | |
| 6,308,909 | B1 * | 10/2001 | McNeil et al. | 242/527.4 |
| 6,354,530 | B1 | 3/2002 | Byrne et al. | |
| 6,488,226 | B2 * | 12/2002 | McNeil et al. | 242/521 |
| 6,536,702 | B1 * | 3/2003 | Vargo et al. | 242/530.2 |
| 6,565,033 | B1 | 5/2003 | Biagiotti | |
| 6,595,458 | B1 | 7/2003 | Biagiotti | |
| 6,595,459 | B2 | 7/2003 | Hanson | |
| 6,648,266 | B1 | 11/2003 | Biagiotti et al. | |
| 6,659,387 | B2 | 12/2003 | Biagioni et al. | |
| 6,698,681 | B1 | 3/2004 | Guy et al. | |
| 6,715,709 | B2 | 4/2004 | Stephens et al. | |
| 6,729,572 | B2 | 5/2004 | Baggot et al. | |
| 6,752,344 | B1 | 6/2004 | Biagiotti | |
| 6,752,345 | B2 | 6/2004 | Betti et al. | |
| 6,834,824 | B1 | 12/2004 | Smith | |
| 6,866,220 | B2 | 3/2005 | Sosalla et al. | |
| 2002/0130212 | A1 | 9/2002 | Yamasaki | |
| 2003/0226928 | A1 | 12/2003 | McNeil et al. | |

FOREIGN PATENT DOCUMENTS

| | | | |
|---|---|---|---|
| EP | 0514226 | A1 | 11/1992 |
| EP | 1 375 402 | | 1/2004 |
| WO | WO 99/02439 | | 1/1999 |
| WO | WO 99/42393 | A1 | 8/1999 |
| WO | WO 01/16008 | A1 | 3/2001 |
| WO | WO 02/055420 | A1 | 7/2002 |
| WO | WO 03/074398 | A2 | 9/2003 |

* cited by examiner

PROCESS FOR WINDING A WEB MATERIAL

FIELD OF THE INVENTION

The present invention relates to a process for converting large rolls of wound web material into a finally wound product suitable for use by a consumer.

BACKGROUND OF THE INVENTION

Web winders are typically used to form large rolls of wound web material, such as paper and polymeric film materials, known as parent rolls. From the parent rolls, rewinders are employed in order to wind the web material into a rolled product. The rolled product is then cut at designated lengths into the finally wound product. Finally wound products typically created by these machines and processes are toilet tissue rolls, paper toweling rolls, paper rolls, polymeric films, and the like.

There are essentially two types of techniques known in the art for performing the step of rewinding, that is, winding a web material from a parent roll into a rolled product. The first technique used in winding a web material to form a rolled product is known as surface winding. In surface winding, the web material is wound onto the core via contact with belts and/or rotating rolls. A nip is typically formed between these two or more co-acting belt, or roller, systems. The belts or rollers of such systems typically travel in opposite directions at different speeds. The reason for having different speeds lies in the fact that the core that is being driven by the opposed belts or rollers will advance in the direction of the faster moving belt or roller. Usually these belts or rollers are divergent so that the rolled product that is being built upon the core will have enough space to grow in diameter, and will be able to maintain contact with the two diverging belts or rollers. Exemplary surface winders are disclosed in U.S. Pat. Nos. 3,630,462; 3,791,602; 4,541,583; 4,723,724; 4,828,195; 4,856,752; 4,909,452; 4,962,897; 5,104,155; 5,137,225; 5,226,611; 5,267,703; 5,285,979; 5,312,059; 5,368,252; 5,370,335; 5,402,960; 5,431,357; 5,505,405; 5,538,199; 5,542,622; 5,603,467; 5,769,352; 5,772,149; 5,779,180; 5,839,680; 5,845,867; 5,909,856; 5,979,818; 6,000,657; 6,056,229; 6,565,033; 6,595,458; 6,595,459; 6,648,266; 6,659,387; 6,698,681; 6,715,709; 6,729,572; 6,752,344; 6,752,345; and 6,866,220; the following International applications also provide exemplary surface winders; International Publication Nos. 01/16008 A1; 02/055420 A1; 03/074398 A2; 99/02439; 99/42393; and EPO Patent Application No. 0514226 A1.

However, such winders can have drawbacks. First, a typical surface winder provides significant contact between the web material and the winding surfaces during winding. This contact during winding can effectively translate winding torque through the web material leading to crushing of embossments that may be disposed upon an embossed material, smudging images disposed upon a web material having an image disposed thereon, and the like. Also, surface winders are known to exhibit winding log instability during the winding of low-density products.

The second technique used to wind a web material to form a rolled product is known as center winding. In center winding, a core is rotated in order to wind a web material into a roll around the core. Typically, this core is mounted on a mandrel that rotates at high speeds at the beginning of a winding cycle and then slows down as the size of the rolled product being wound upon the core increases in diameter. Center winders work well when the web material that is being wound has a printed, textured, or slippery surface. Additionally, center winders can be useful in producing softer rolled products. Exemplary center winders are discussed in U.S. Pat. Nos. 1,040,188; 2,769,600; 3,697,010; 4,588,138; 5,497,959; 5,660,349; 5,725,176; and U.S. Patent Application Publication No. 2002/0130212 A1.

However, center winders have drawbacks that are known to those of skill in the art. Known drawbacks include the need to provide a harder "pull" when rolling high-density and low-density web materials into a high-density roll. The resulting tension can provide for a Poisson lateral contraction of the web material, resulting in a non-uniformly wound product. Additionally, the application of tension to a perforated web material can cause the web material to rupture at a perforation during processing. This can cause a processing line to shut down.

It is clear that the prior art lacks a winder or rewinder capable of performing both center winding and surface winding in order to take advantage of the positive attributes that both processes enjoy. For example, it would be desirable to provide a winder that is capable of allowing a broader range of finished product roll densities. As will be appreciated by one of skill in the art, this capability, when coupled with known capabilities for imparting perforations at desired intervals and sheet counts in increments of one, can provide for a greatly enhanced product converting flexibility. This, in turn, can allow multiple finished product designs to be achieved using a common substrate. This is believed to provide substantial manufacturing expense savings by reducing changeovers on paper machines and converting lines, thereby avoiding multiple parent roll inventories, and the like. Such a desired hybrid winding system can also provide the capability to wind thick, highly embossed web materials into preferred high density finished product rolls having low sheet tension. As will soon be appreciated by one of skill in the art, this can improve product quality by eliminating sheet elongation and embossment distortion as well as improving winding reliability by providing fewer web material feed breaks in the winding process.

SUMMARY OF THE INVENTION

The present invention provides for a method for rewinding a web material. The method comprises the steps of (1) Disposing the web material on a first surface contact roll, (2) Providing at least one winding spindle proximate the material disposed upon the first surface contact roll, (3) Adjusting the first surface contact roll relative to the at least one winding spindle, and, (4) Transferring the web material to the at least one winding spindle from the first surface contact roll.

Another embodiment of the present invention provides for a method for winding web material. The method comprises the steps of (1) Providing a first surface contact roll, the first surface contact roll having a surface, (2) Transferring the web material to the surface of the first surface contact roll, (3) Adjusting the first surface contact roll relative to a first winding spindle, (4) Subsequently transferring the web material from the surface of the first surface contact roll to the first winding spindle, and, (5) Disposing the web material upon the first winding spindle to produce a finally wound product.

Yet another embodiment of the present invention provides for a method for converting a web material into a wound roll. The method comprises the steps of (1) Depositing the web material onto a first surface contact roll, (2) Moving the web material deposited upon the first surface contact roll proximate to a winding spindle, (3) Adjusting the first surface contact roll relative to the winding spindle, (4) Rotating the winding spindle, and, (5) Transferring the web material from the first surface contact roll to the winding spindle.

DETAILED DESCRIPTION OF THE INVENTION

In the prior art, a winder or reel is typically known as a device that performs the very first wind of that web material, generally forming what is known as a parent roll. A rewinder, on the other hand, is generally known as a device that winds the web material from the parent roll into a roll that is essentially the finished product. For purposes of the present application, the words "winder" and "rewinder" are interchangeable with one another in assessing the scope of the claims.

The terms machine direction (MD), cross-machine direction (CD), and Z-direction are generally relative to the direction of web material 12 travel. The machine direction is known to those of skill in the art as the direction of travel of web material 12. The cross-machine direction is orthogonal and coplanar thereto. The Z-direction is orthogonal to both the machine and cross-machine directions.

Figure 1:
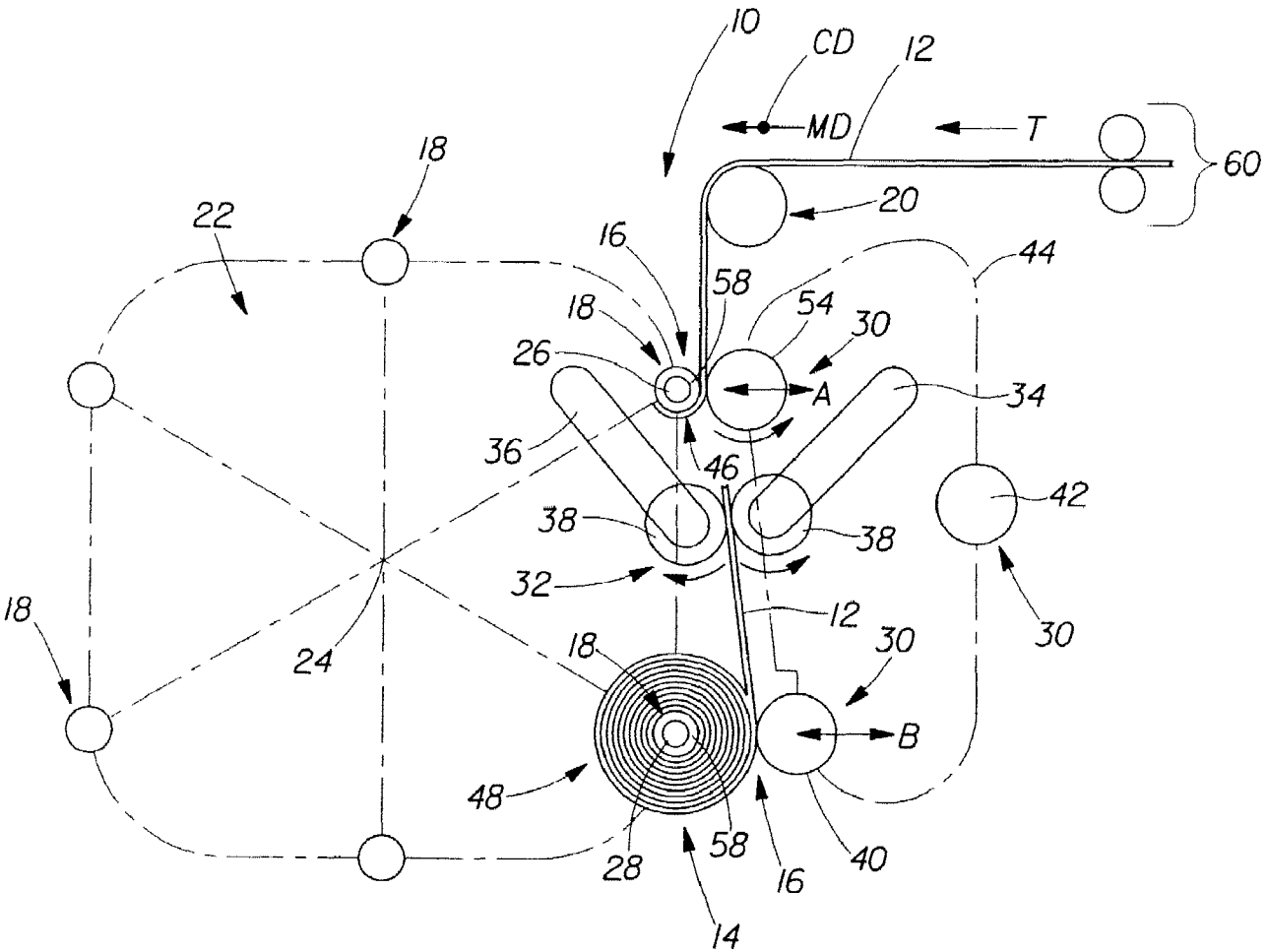
FIG. 1 is a cross-sectional view of an exemplary embodiment of a winder at about 0 machine degrees in accordance with the present invention.

Referring now to the drawings, FIG. 1 shows a cross-sectional view of an exemplary winder 10 in accordance with the present invention. The winder 10 is suitable for use in winding a web material 12 to produce a finally wound product 14. The finally wound product 14 that may be produced by the winder 10 of the present invention can be any number of types of products such as hand towels, toilet tissue, paper towels, polymeric films, trash bags, and the like. As such, web material 12 can comprise continuous web materials, discontinuous web materials comprising interleaved web segments, combinations thereof, and the like. Exemplary materials suitable for web material 12 of the present invention include, without limitation, metal foils, such as aluminum foil, wax paper or grease-proof paper, polymeric films, non-woven webs, fabrics, paper, combinations thereof, and the like. The web material 12 is shown as being transported by the winder 10 in the direction indicated by the arrow T. The winder 10 transports the web material 12 into contacting engagement with at least a first set of cooperative rollers 16. Cooperative rollers 16 generally comprise a winding spindle 18 and a roll 30 also disclosed herein as a surface contact roll 30.

The web material 12 can be transported and/or assisted by an exemplary web delivery system 20 into winding contact with at least one winding spindle 18. In a preferred embodiment, a plurality of winding spindles 18 are disposed upon a winding turret 22 indexable about a center shaft thereby defining winding turret axis 24. The winding turret 22 is preferably indexable, or moveable, about winding turret axis 24 through an endless series of indexed positions. For example, a first winding spindle 26 can be located in what may conveniently be called an initial transfer position and a second winding spindle 28 can be located in what may conveniently be called a final wind position. In any regard, the winding turret 22 is indexable about winding turret axis 24 from a first index position to a second index position. Thus, the first winding spindle 26 is moved from the initial transfer position into the final wind position. Such indexable movement of the first winding spindle 26 disposed upon winding turret 22 about winding turret axis 24 may comprise a plurality of discrete, defined positions or a continuous, non-discrete sequence of positions. However, it should be appreciated that winding spindle 18 can be brought into proximate contact with a roll 30 by any means known to one of skill in the art. Exemplary, but non-limiting, turrets suitable for use with the present invention (including "continuous motion" turrets) are disclosed in U.S. Pat. Nos. 5,660,350; 5,667,162; 5,690,297; 5,732,901; 5,810,282; 5,899,404; 5,913,490; 6,142,407; and 6,354,530. As will also be appreciated by one of skill in the art, the so-called 'open-loop' turret systems would also be suitable for use as a support for the disposition and movement of winding spindles 18 used in accordance with the present invention. An exemplary, but non-limiting, 'open-loop' turret system is disclosed in International Publication No. WO 03/074398.

If so desired by the practitioner, the roll 30 of the present invention may be provided with a relieved surface. In such an embodiment, the relieved portions can be provided as a pattern disposed upon, or within, the material comprising roll 30. Such a pattern may be disposed upon, or otherwise associated with roll 30 by laser engraving, mechanical implantation, polymeric curing, or the like. In an exemplary, but non-limiting embodiment, such a pattern, relieved or otherwise, may correspond to any indicia, embossments, topography pattern, adhesive, combinations thereof, and the like, that are disposed upon, or disposed within, web material 12. It is believe that such an exemplary pattern associated with a roll 30 may be registered with respect to any direction, or directions, of web material 12, particularly the machine- and/or the cross-machine directions of web material 12. Such a pattern can be associated with a roll 30 and can be provided relative to any indicia, embossments, topography pattern, combinations thereof, or the like, associated with web material 12 by any means known to one of skill in the art. Such an embodiment may be useful in preserving desirable features in the web material 12 such as embossments, or may provide a desired contact force, such as for improved bonding force in discrete and/or desired areas of a two-ply, or other multiple-ply, product comprising adhesive for joining one ply to another. Similarly, the roll 30 can be provided with embossments and/or any other type of topographical pattern corresponding to the portions of a multi-ply type of web material 12 that may have an adhesive or other bonding formulation or structure disposed between the plies forming such a web material 12 structure. A roll 30 provided with such embossments and/or any other type of topographical pattern disposed thereon can provide for better adhesion and/or bonding of the plies forming a multi-ply web material 12 by providing additional pressure to the region sought to be so bonded as would be known to one of skill in the art. Without desiring to be bound by theory, it is believed that such increased bonding can be useful for the prevention of so-called "skinned" rolls wherein the plies of a multiple-ply finally rolled product 14 separate during dispensing by the consumer. This is known to those of skill in the art as an undesirable quality defect.

In a preferred embodiment of the present invention, the roll 30 is driven at a surface speed that corresponds to the speed of the incoming web material 12. A positioning device (not shown), such as linear actuators, servo motors, cams, links, and the like, known by those of skill in the art as useful for such a result, can be provided for control of the position of the longitudinal axis of roll 30 relative to the longitudinal axis of a winding spindle 18. Such a positioning device (not shown) associated with a roll 30 is preferably capable of moving the roll 30 in any direction, including, but not limited to, the machine direction, the cross-machine direction, the Z-direction, and/or any combination thereof. In a preferred embodiment, the movement of a roll 30, is generally parallel to the Z-direction relative to web material 12 as web material 12 passes proximate to, or in contacting engagement with, a winding spindle 18. It is believed that in this way, the position of the roll 30, when combined with the known diameter growth of the log associated with second winding spindle 28, can provide the required contact, clearance, and/or pressure between the roll 30 and the log associated with second winding spindle 28 having web material 12 being disposed thereon. However, it should be realized that the roll 30 can be provided with movement with respect to any direction relative to its longitudinal axis in virtually any direction required to provide the required contact or clearance between the roll 30 and the log associated with second winding spindle 28. Likewise, the roll 30 can have virtually any number of axes (i.e., at least one) associated thereto as required in order to provide the required contact or clearance between the roll 30 and the log associated with second winding spindle 28 as web material 12 passes therebetween.

If contact between the roll 30 through web material 12 to the log associated with second winding spindle 28 is desired, the position of a respective roll 30 along an exemplary axis A and/or B, can be controlled to a known position in order to provide the desired contact, or clearance, between the respective roll 30 and the respective log associated with the first or second winding spindle 26, 28 throughout the entire wind, if required. Maintaining desired contact, or clearance, throughout the entire wind may be particularly advantageous when winding products having higher densities. Maintaining contact throughout the wind, in such an instance is believed to facilitate compaction of all layers of web material 12 within the finally wound product 14, thereby providing maximum potential density. Maintaining contact throughout the entire wind is also believed to provide product consistency when the web material 12 comprises a structure that is affected by contact force against the roll 30. By way of example, embossed areas disposed upon web material 12 may have a different appearance or thickness in a region contacted by the roll 30 compared to an area of roll 30 not so contacted.

Alternatively, the position of roll 30 can be positioned along axis A and/or B respectively in order to regulate the contact force between the roll 30 and the respective log associated with first or second winding spindle 26, 28. By way of example, in order to provide a low density product roll design upon finally wound product 14, there may be minimal, or even no, contact between the respective roll 30 and the log associated with second winding spindle 28. For medium density product roll designs in finally wound product 14, there may be moderate contact, or force, between the respective roll 30 and the log associated with second winding spindle 28. For providing high density product roll designs in finally wound product 14, there may be relatively high contact, or force, between the respective roll 30 and the log associated with second winding spindle 28. In any regard, it is preferred that the rotational speed of the winding spindles 18 be controlled in order to decelerate at a rate that maintains the same winding surface speed, or desired speed differential, as the diameter of the log associated with second winding spindle 28 increases.

Alternatively, the product density of a finally wound product 14 can be adjusted by adjusting the surface speed of the roll 30 and/or the surface speed of the respective log associated with first or second winding spindle 26, 28. Without desiring to be bound by theory, it is believed that providing such a speed differential between the surface speed of the roll 30 and/or the surface speed of the respective log associated with first or second winding spindle 26, 28 can vary the tension present in the web material 12 forming finally wound product 14. By way of non-limiting example, in order to provide a low density finally wound product 14, there may be minimal, or even no, speed differential between the surface speed of the roll 30 and/or the surface speed of the log associated with second winding spindle 28. However, if a high-density finally wound product 14 is desired, there may be relatively high speed differential, or bias, between the surface speed of the roll 30 and/or the surface speed of the log associated with second winding spindle 28. In any regard, the surface speeds of the roll 30 and/or the log associated with second winding spindle 28 can be controlled jointly, or severally, in order to provide a finally wound product 14 having the desired wind profile.

As shown in FIG. 1, the winder 10 preferably provides a turret 22 supporting a plurality of winding spindles 18. The winding spindles 18 preferably engage a core 58 upon which the web material 12 is wound. The winding spindles 18 are preferably driven in a closed spindle path about the winding turret 22 assembly central axis 24. Each winding spindle 18 extends along a winding spindle 18 axis generally parallel to the winding turret 22 assembly winding turret axis 24, from a first winding spindle 18 end to a second winding spindle 18 end. The winding spindles 18 are preferably supported at their first ends by the winding turret 22 assembly. The winding spindles 18 are preferably releasably supported at their second ends by a mandrel cupping assembly (not shown). The winding turret 22 preferably supports at least two winding spindles 18, more preferably at least six winding spindles 18, and in one embodiment, the turret assembly 22 supports at least ten winding spindles 18. As would be known to one of skill in the art, a winding turret assembly 22 supporting at least 10 winding spindles 18 can have a rotatably driven winding turret 22 assembly which is rotated at a relatively low, and preferably, generally constant, angular velocity to reduce vibration and inertial loads, while providing increased throughput relative to indexing a winding turret 22 which is intermittently rotated at higher angular velocities. Exemplary winding turret assemblies suitable for use with the present invention are disclosed in U.S. Pat. Nos. 5,690,297 and 5,913,490.

A perforator roll, anvil, or any other non-contact perforation device 60 known by those of skill in the art can be adapted to provide lines of perforations extending along the cross-machine direction of the web material 12. Adjacent lines of perforations are preferably spaced apart at a pre-determined distance along the length of the web material 12 to provide individual sheets of web material 12 that are joined together at the perforations. The sheet length of the individual sheets of web material 12 is the distance between adjacent lines of perforations.

Once the desired number of sheets of web material 12 have been wound onto a log associated with second winding spindle 28, in accordance with the present invention, a web separator 32 can be moved into a position proximate to web material 12 disposed between successive cooperative rollers 16 (i.e., successive rolls 30 and successive winding spindles 18) in order to provide separation of adjacent sheets of perforated web material 12. The web separator 32 can be provided as a rotary unit shearing apparatus known to those of skill in the art useful for the severance of the web material 12 into individual sheets. In a preferred embodiment, the web separator 32 is provided as a pair of articulating elements 34, 36 that cooperatively engage web material 12 in a position intermediate successive cooperative rollers 16 (i.e., a first roll 30 and a first winding spindle 26 and a second roll 30 and second winding spindle 28). In such a preferred embodiment, the web separator 32 intermittently and/or periodically contactingly engages the web material 12 disposed between successive cooperating rollers 16. Alternatively, a suitable web separator 32 for the present invention can be provided as a plurality of semi-continuous speed rolls (not shown) that are constantly in contact with the web material 12 disposed between successive cooperating rollers 16. The elements comprising such a semi-continuous web separator 32, either individually or collectively, can be provided with momentary periods of acceleration or deceleration. Yet still, the web separator 32 can be provided with a plurality of contacting arms provided with surfaces 38 such as a smooth rubber surfaces and/or pressers, or pads, intended to exert a pressure, through a slight interference, against an opposing surface 38 such as a smooth rubber surface and/or pressers, or pads. In such an embodiment, each element, such as exemplary articulating arms 34, 36, of the web separator 32 preferably rotate intermittently, in a clockwise or counterclockwise direction respectively. However, in any regard, each element 34, 36 of the web separator 32 may be provided with a pendulum-like oscillatory movement. As such, the surfaces 38 comprising pressers or pads disposed upon each element 34, 36 of web separator 32 preferably move along a circular path which has an axis coincident with the axis of rotation of each element of the web separator 32 and almost tangent to (or making a slight interference with) the surface of the opposing element of web separator 32 comprising winder 10.

Once the desired number of sheets of web material 12 have been wound onto the log associated with second winding spindle 28, the web separator 32 is moved (i.e., pivoted) into a position which facilitates the formation of a nip between the opposing elements 34, 36 associated with the web separator 32. Such a nip may comprise the surfaces 38 such as rollers, pressers, or pads, cooperatively associated with the elements 34, 36 associated with web separator 32. The movement of the elements 34, 36 comprising web separator 32 are preferably timed so that the web separator 32 nips the web material 12 between opposing elements 34, 36 of web separator 32 when the perforation at the trailing end of the last desired sheet for the log associated with second winding spindle 28 is located between the cooperative rollers 16 comprising the first, or new, winding spindle 26 and a first surface contact roll 30 at the transfer position (i.e., at the web material 12 nip point) and the contact point of the elements 34, 36 comprising web separator 32.

Additionally, the portions of the elements 34, 36 of web separator 32 that form the nip against the web material 12 can be provided with surface speeds that are either less then, the same as, or greater than, the surface speed of the web material 12 cooperatively associated thereto. In a preferred embodiment, at least one element 34, 36, or the surfaces 38 thereof, forming the web separator 32 is provided with a surface speed greater than that of the surface speed of the web material 12 cooperatively associated thereto. Without desiring to be bound by theory, it is believed that if one element 34, 36, or the surfaces 38 thereof, comprising web separator 32 is provided with a low coefficient of friction and the corresponding element 34, 36, or the surfaces 38 thereof, of web separator 32 is provided with a surface speed greater than that of web material 12, the web separator 32 effectively accelerates the web material 12 at the nip point because the web material 12 slips relative to one element 34, 36, or the surfaces 38 thereof, comprising web separator 32 traveling at the desired web material 12 winding speed. Concurrent with such over-speed nip formation between corresponding elements 34 comprising web separator 32, a succeeding new winding spindle 18 that will form the log associated with first winding spindle 26, traveling at the same surface speed as the web material 12, nips the web material 12 against a roll 30 thereby forming cooperative rollers 16. Such a combination of the downstream over-speed nip formation between engaging elements 34, 36 comprising web separator 32 and the winding speed upstream nip formation between cooperative rollers 16 causes the perforation disposed upon web material 12 located between the two nip points to break resulting in the formation of a finally wound product 14 having the desired number of sheets of web material 12 disposed thereon resulting from the log associated with second winding spindle 28.

Alternatively, one of elements 34, 36 comprising web separator 32 can be provided with a surface speed lower than that of the surface speed of the web material 12 cooperatively associated thereto. If one of the elements 34 comprising web separator 32 is provided with a low coefficient of friction and the corresponding second element 36 comprising web separator 32 is provided with a surface speed lower than that of the first element 34 comprising web separator 32, the second element 36 comprising web separator 32 can decelerate the web material 12 at the nip point. This is because the web material 12 slips relative to the first element 34 comprising web separator 32 causing the perforation disposed between the elements 34, 36 comprising web separator 32 and cooperative rollers 16 (i.e., second winding spindle 28/roll 30) nip points to break resulting in the formation of a finally wound product 14 having the desired number of sheets of web material 12 disposed thereon resulting from the log associated with second winding spindle 28. Concurrent with such an under-speed nip formation between the elements 34, 36 comprising web separator 32, a succeeding new winding spindle 18 that will form the log associated with first winding spindle 26, traveling at the same surface speed as the web material 12, nips the web material 12 against the respective roll 30 corresponding and cooperatively associated thereto. That portion of web material 12 disposed beyond the nip formed between first winding spindle 26 and the roll 30 cooperatively associated thereto can then be recalled and wound upon first winding spindle 26.

In yet still another embodiment, the elements 34, 36 comprising web separator 32 can be surface-speed matched with web material 12. In such an embodiment, one element 34 comprising web separator 32 is preferably provided with at least one blade that is inter-digitating and/or nestably related with a corresponding depression, groove, and/or blade, retractable or otherwise, disposed upon second element 36 comprising web separator 32. It is believed that such inter-digitating and/or nestable blade assemblies known by those of skill in the art can be adapted to provide such a surface speed-matched web separator 32 assembly. By way of non-limiting example, the assemblies discussed in U.S. Pat. Nos. 4,919,351 and 5,335,869 can be adapted to provide such a surface speed-matched web separator 32 assembly suitable for use with the present invention.

The web material 12 upstream of the nip formed between the elements 34, 36 comprising web separator 32 is then transferred to a new winding spindle 18 which has had an adhesive disposed thereon to form first winding spindle 26. In a preferred embodiment, a core is disposed upon the new winding spindle 18 that forms first winding spindle 26 and is held securely thereto. The winding turret 22 comprising the winding spindles 18 moves the first winding spindle 26 to the finish wind position, either intermittently or continuously, and the winding cycle is repeated. After the wind has been completed, the finally wound product 14 is removed from first winding spindle 26 disposed upon turret assembly 22 and a new core is preferably disposed upon the now vacant winding spindle 18. Adhesive can then be applied to the new core prior to the web transfer. The winding sequence is then repeated as required.

As described previously, a preferred embodiment of the present invention includes winding the web material 12 on hollow cores for easier roll mounting and dispensing by the consumer. Additionally, the winder 10 of the instant invention provides for adjustable sheet length capability in order to provide format flexibility and sheet count control in increments of one for such format flexibility.

Further, one of skill in the art could provide the winding spindles 18 with a speed profile that can allow for enhanced winding capability of winder 10. Such enhanced winding capability may be useful or even preferable with low-density substrates. Additionally, disposing web material 12 between the first winding spindle 26 and a corresponding and engaging roll 30 forming cooperative rollers 16 can provide for an adjustable contact position and/or force upon winding spindle 18 and the web material 12 at the periphery of the log associated with second winding spindle 28. Providing second winding spindle 28 with an adjustable rotational speed can provide for the ability to apply a force at the point where web material 12 is disposed upon second winding spindle 28. This process can provide for a finally wound product 14 having the desired wind profile.

For example, finally wound product 14 may be produced by a web material 12 having a perforated sheet length of 250 mm, a 100 sheet count, a finished roll diameter of 130 mm, and be wound upon a core having an outer diameter of 40 mm. Using this information, the theoretical average radial thickness for each layer of web material 12 comprising finally wound product 14 can be calculated to be about 480 μm. In such an exemplary embodiment, the web material 12 may be provided with an initial (i.e., untensioned) thickness of 750 μm as web material 12 enters the winding area of winder 10. In order to provide for the above-described finally wound product 14, if no contact exists between the log associated with a winding spindle 18 and the corresponding surface contact roll 30, the web material 12 must be compressed from the initial thickness of 750 μm to the required theoretical target thickness of 480 μm by only the tension exerted by the winding spindle 18 speed on the incoming web material 12. Without desiring to be bound by theory, the calculated tension required to decrease the thickness of web material 12 from an initial 750 μm thickness to the required 480 μm thickness is about 500 grams per linear cm. However, one of skill in the art will appreciate that the web material 12 may separate uncontrollably at the perforations disposed within web material 12 when web material 12 is subject to such a tension (i.e., nominally greater than 350 grams per linear cm). Such uncontrolled separations can produce an unacceptable finally wound product 14 and potentially result in line/production stoppages.

Additionally, the winder 10, as disclosed supra, may be utilized to provide supplemental compression of the web material 12 being wound upon a winding spindle 18 to produce finally wound product 14. For example, a roll 30 may be loaded against the log associated with the corresponding winding spindle 18 by moving the position of the roll 30 relative to a winding spindle 18 in order to achieve the desired finally wound product 14. For example, a roll 30 may be loaded against a log disposed upon a corresponding winding spindle 18 with a force of 100 grams per linear cm. By calculation, it is believed that such a force may decrease the thickness of the web material 12 from a thickness of 750 μm to a thickness of 500 μm. The calculated required winding tension to further decrease the thickness of web material 12 from a thickness of 500 μm to the required thickness of 480 μm may be provided with as little as 40 grams per linear cm. This required tension level is well below the known, and assumed, perforation separation level of 350 grams per linear cm, thereby allowing reliable production of the desired finally wound product 14.

Additionally, one of skill in the art will understand that the winder 10 disclosed herein can provide contact with the log associated with second winding spindle 28 throughout the entirety of the wind cycle. Thus, a finally wound product 14 can be provided with heretofore unrealized wind uniformity throughout the entire finally wound product 14. Further, one of skill in the art will realize that providing winding spindles 18 in a turret system 22 moving in a closed path can provide for continuous winding and removal of finally wound product 14 without the need to interrupt the turret system 22 to load and unload winding spindles 18 or even the cores disposed upon winding spindles 18 from a moving turret system 22 mechanism.

Process

As used herein, a "machine degree" is equivalent to 1/360 of a complete cycle. With regard to the winder 10 described herein, 360 machine degrees is defined as a complete rewind cycle, that is, from a first identified index position (such as an initial transfer position or a final wind position) to the next identical and succeeding index position (such as the subsequent, or second, identical initial transfer position or the, subsequent or, second identical final wind position).

Referring again to FIG. 1, the winder 10 of the present invention is shown at about 0 machine degrees. The web material 12 disposed between first winding spindle 26/first surface contact roll 54 and second winding spindle 28/second surface contact roll 40 has been separated at an identified perforation by web separator 32. Web separator 32 provides for a nip, or pinch, of the web material 12 disposed between the first element 34 and the second element 36 comprising web separator 32 proximate to the identified perforation. Concurrent with the separation of web material 12 at the identified perforation, first surface contact roll 54 is moveable along an exemplary axis A as well as the machine direction axis 44 to facilitate compression of the leading edge of web material 12 against the winding spindle 18 forming new log 46. In a preferred embodiment, each winding spindle 18 is provided with a core having an adhesive disposed upon the surface thereof to facilitate attachment of the leading edge of the web material 12 to the respective winding spindle 18. Further, the remaining web material 12 attached to winding spindle 18 forming old log 48, continues to be disposed thereon. Second surface contact roll 40 supporting web material 12 is moveable about an exemplary axis B and, if required, machine direction axis 44, in order to provide for a desired pressure to be exerted upon old log 48 having web material 12 disposed thereon. It is in this manner that old log 48 can be provided with a desired wind profile during the entirety of the winding process.

It should be realized that the position and/or loading force of the first surface contact roll 54, the second surface contact roll 40, and the third surface contact roll 42 relative to any of winding spindles 18 are preferably independently adjustable. The position of the surface contact rolls 40, 42 shown herein can be adjusted such that they maintain the desired contact force or position relative to the respective winding spindle 18 at all points during the winding cycle. Additionally, in order to ensure a reliable web material 12 transfer to winding spindle 18 forming new log 46, the first surface contact roll 54 is initially driven at a surface speed that corresponds to the speed of the incoming web material 12 and the surface speed of the first winding spindle 26. In a non-limiting embodiment, a positioning device, such as a linear actuator, can control the position of the first surface contact roll 54 (as well as the position of the second surface contact roll 40 and the third surface contact roll 42). In any regard, the position of any of the surface contact rolls 40, 42, combined with the known diameter growth of the desired winding log can determine the contact or clearance between each respective roll and winding logs. If contact is desired, such contact may be controlled to a known position or interference or alternatively, by regulating the contact force between each respective roll and winding log. By way on non-limiting example, if low density product roll designs are desired, there may be no contact between the respective surface contact roll and the winding log. By further example, if medium density product roll designs are desired, there may be moderate contact or force between the respective surface contact roll and the winding log. Yet further, if high-density product roll designs are desired, there may be relatively high contact or force provided between the respective surface contact roll and the winding log.

In any regard, it is preferred that all of the surface contact rolls 40, 42 provided herein contact the respective winding log at the tangent point of the incoming web material 12. This is believed to provide maximum winding density effect with minimum degradation of the finally wound product 14, which can be exhibited as a sheet caliper loss. In all cases, the rotational speed of the winding spindle 18 is controlled to decelerate at a rate that maintains the same winding surface speed, or desired differential, as the winding log diameter increases. It is believed that such profiled mandrel drive systems are well known to those of skill in the art.

Figure 2:
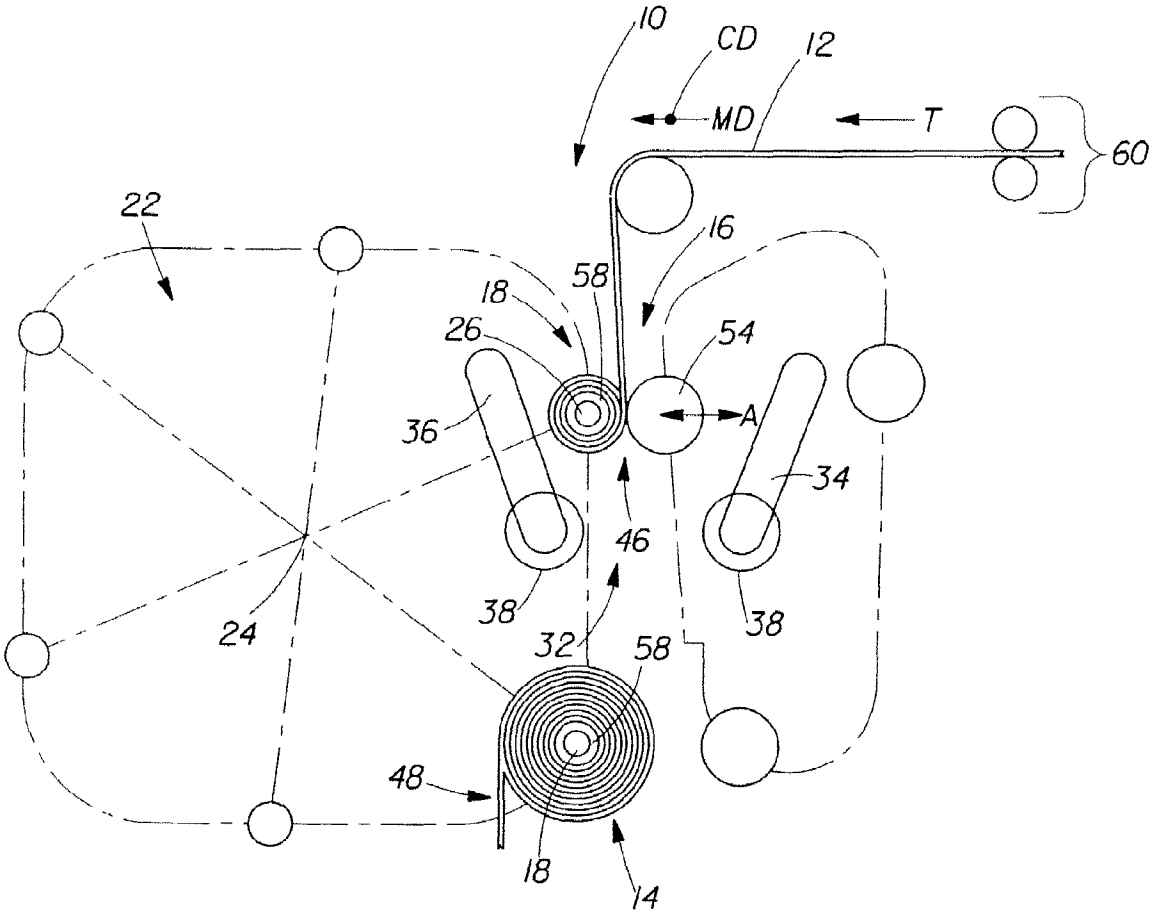
FIG. 2 is a cross-sectional view of the exemplary embodiment shown in FIG. 1 at about 24 machine degrees.

FIG. 2 depicts the winder 10 of the present invention at about 24 machine degrees. As shown, the new log 46 is indexed by the turret system 22 from the initial transfer position to the end of wind position, the first surface contact roll 54 is similarly indexed to maintain the desired contact, or pressure, with the new log 46. Preferably, contact and/or pressure exerted upon the new log 46 by the first surface contact roll 54 is maintained throughout the entirety of the winding cycle. However, as would be known to one of skill in the art, and as discussed supra, contact between the new winding log 46 and the first surface contact roll 54 can be provided as required in accordance to produce a finally wound product 14 having the characteristics desired. For example, the contact position, pressure, and/or force, may be controlled to any desired value from the beginning of the wind cycle to the end of the wind cycle as new log 46 progresses from the initial transfer position to the final wind position. As depicted, web material 12 is being disposed upon the winding spindle 18 to form new log 46, as new log 46 progresses from the first initial contact position to the final log winding position. Concurrent with new winding log 46 growth upon winding spindle 18, the speed at which winding spindle 18 turns is preferably adjusted to maintain a matched surface speed of new log 46 with incoming web material 12 contacting, or disposed upon, first surface contact roll 54. Additionally, first surface contact roll 54 can be provided with movement along axis A in order to provide the desired contact, or pressure, upon new log 46 as the diameter of new log 46 increases radially due to deposition of web material 12 thereupon. Concurrent with the movement of new log 46 towards a final wind position, web separator 32, and the elements 34, 36 comprising web separator 32 are positioned away from the region of nip formation between the surface 38 of element 34 and the surface 38 of element 36 comprising web separator 32. Further, old log 48 can be removed from turret assembly 22 and a new core, if required, can be disposed upon the winding spindle 18 previously occupied by old log 42 forming finally wound product 14.

Figure 3:
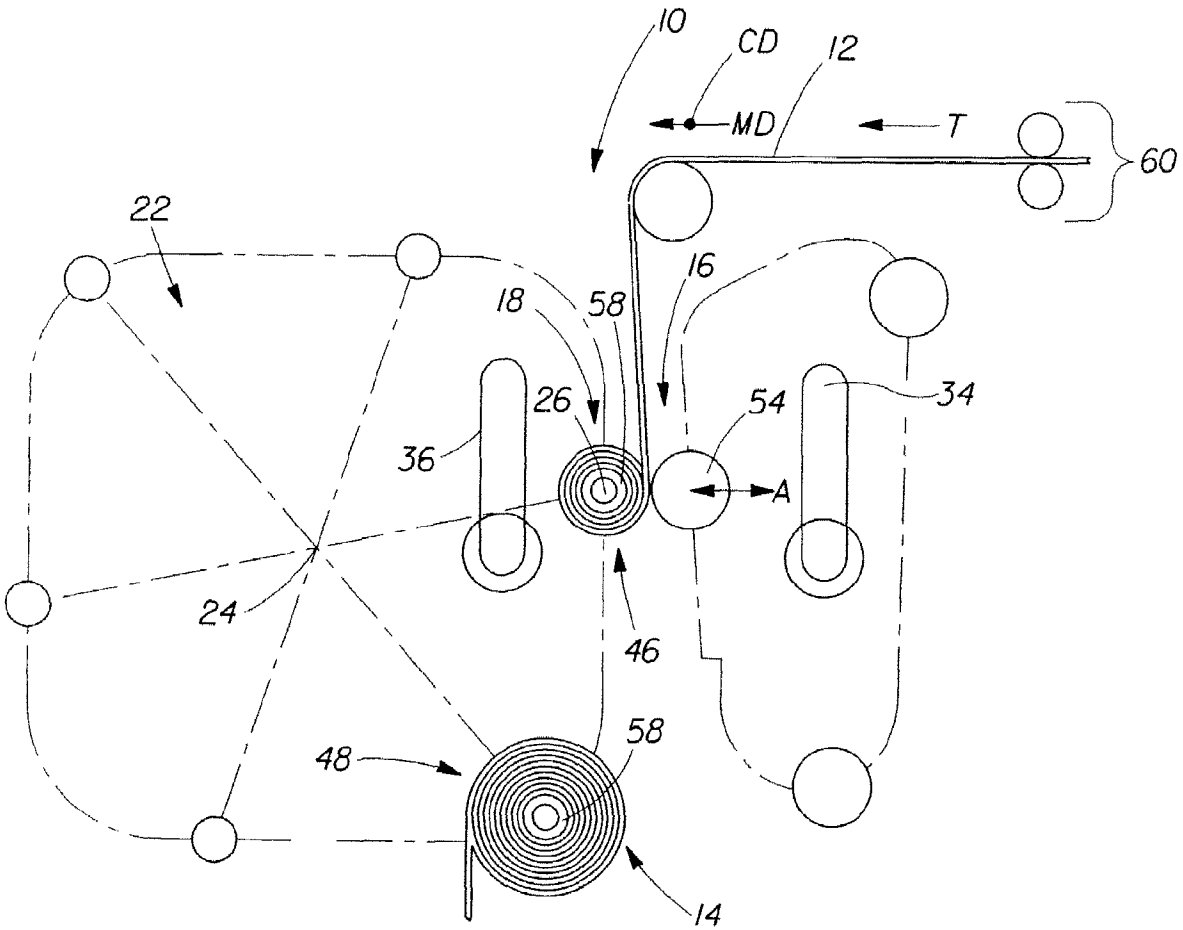
FIG. 3 is a cross-sectional view of the exemplary embodiment shown in FIG. 1 at about 48 machine degrees.

FIG. 3 depicts the winder 10 of the present invention as would be seen at about 48 machine degrees. In this position, the new log 46 continues to display radial growth as web material 12 is rotationally disposed thereupon. As required, the position of first surface contact roll 54 can be adjusted along exemplary axis A, either with or without adjustment of the machine direction position of the first surface contact roll 54, in order to provide the desired surface pressure upon new log 46 in order to provide for the desired winding profile. As new log 46 progresses orbitally about axis 24 of turret assembly 22, old log 48 having web material 12 disposed thereupon can be prepared for removal from the turret assembly 22 as finally wound product 14.

Figure 4:
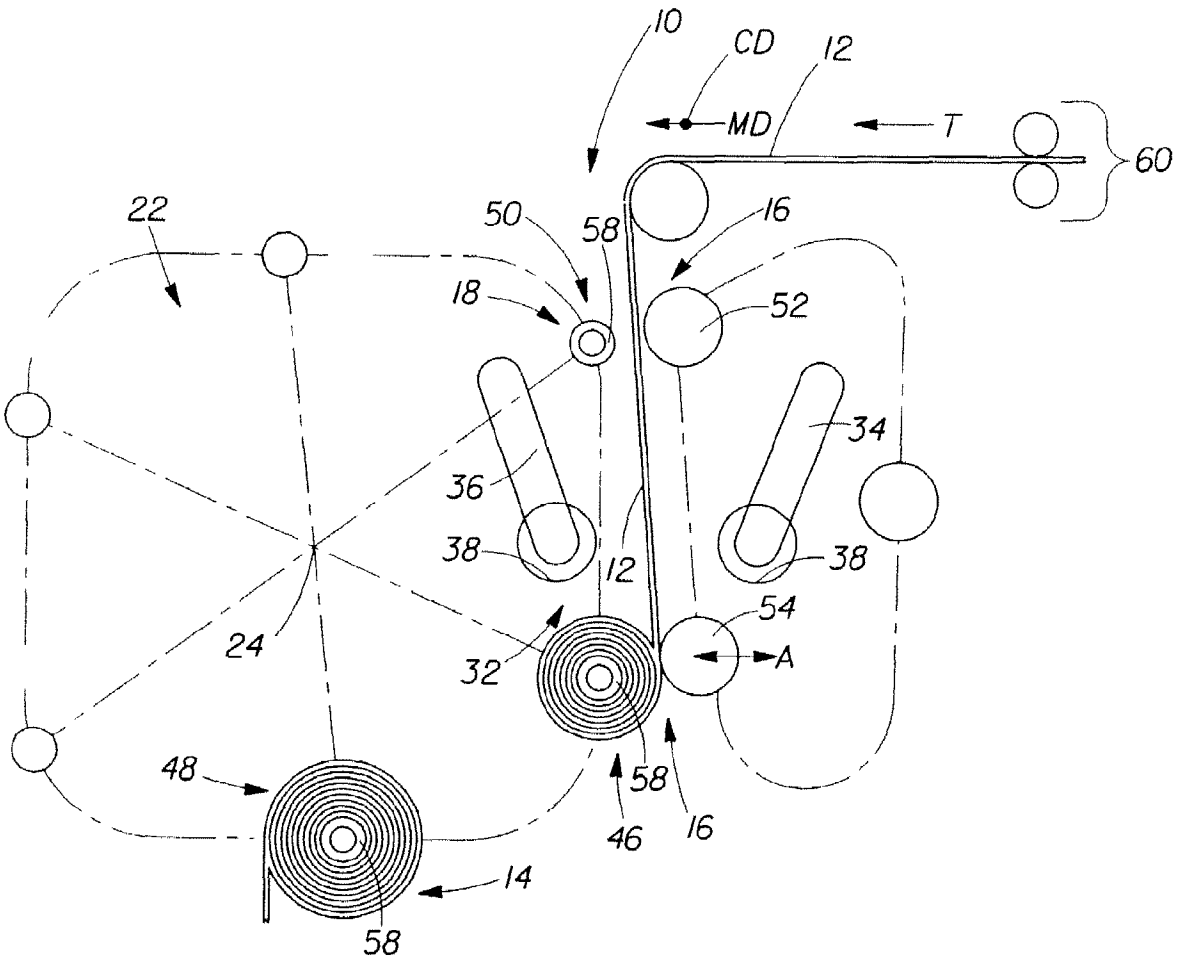
FIG. 4 is a cross-sectional view of the exemplary embodiment shown in FIG. 1 at about 120 machine degrees.

FIG. 4 depicts the winder 10 of the present invention at about 120 machine degrees. At this point, new winding log 46 is experiencing radial growth due to the continued deposition of web material 12 thereupon. In a preferred embodiment, the position of first surface contact roll 54 can be adjusted along axis A in order to provide the desired contact, or pressure, of first surface contact roll 54 upon new winding log 46 in order to provide the desired wind profile as web material 12 is disposed thereon. Concurrently, a third surface contact roll 52 can be positioned proximate to a winding spindle 18 that will form a second new log 50. Additionally, the elements 34, 36 and the associated surfaces 38 of web separator 32 are each moved into a position proximate to web material 12 in order to facilitate separation of web material 12 at the desired perforation as described supra.

Figure 5:
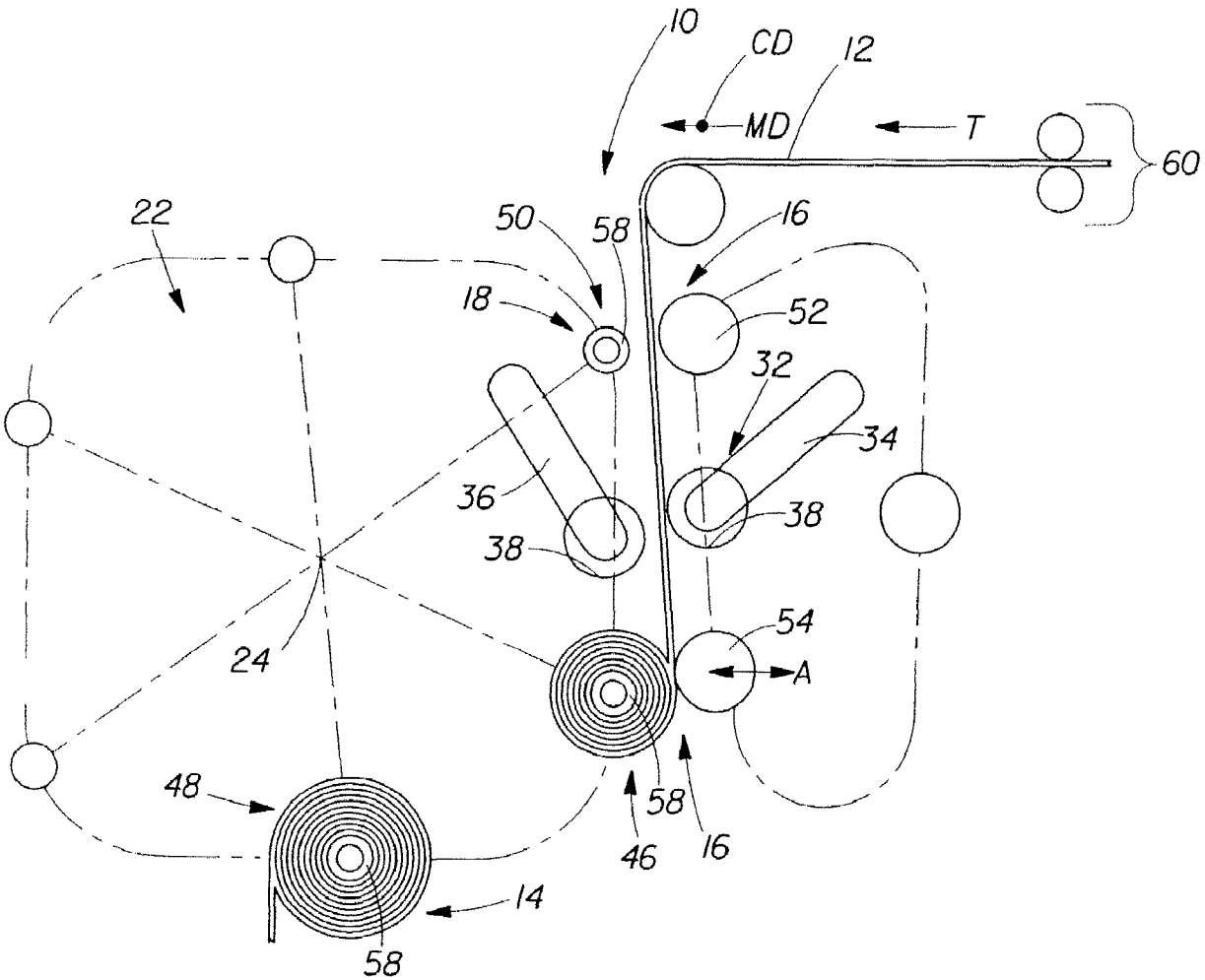
FIG. 5 is a cross-sectional view of the exemplary embodiment shown in FIG. 1 at about 336 machine degrees; and, FIG. 6 is a cross-sectional view of the exemplary embodiment shown in FIG. 1 at about 359 machine degrees.

FIG. 5 depicts the winder 10 of the present invention at approximately 336 machine degrees. At this point, new log 46 is continuing to experience radial growth due to continued deposition of the web material 12 thereupon. The position of first surface contact roll 54 is adjusted along axis A in order to provide the desired contact, or pressure, of the first surface contact roll 54 upon new log 46 in order to provide desired wind profile as web material 12 is disposed thereon. Concurrently, third surface contact roll 52 is moved proximate to web material 12 and the winding spindle 18 that will form second new log 50. Additionally, each of elements 34, 36 and the surfaces 38 attached thereto comprising web separator 32 are moved to a position proximate to, or in contacting engagement with, web material 12 in order to facilitate separation of web material 12 at the desired perforation as described supra. As required, old log 48 comprising finally wound product 14 can be removed from turret assembly 22.

Figure 6:
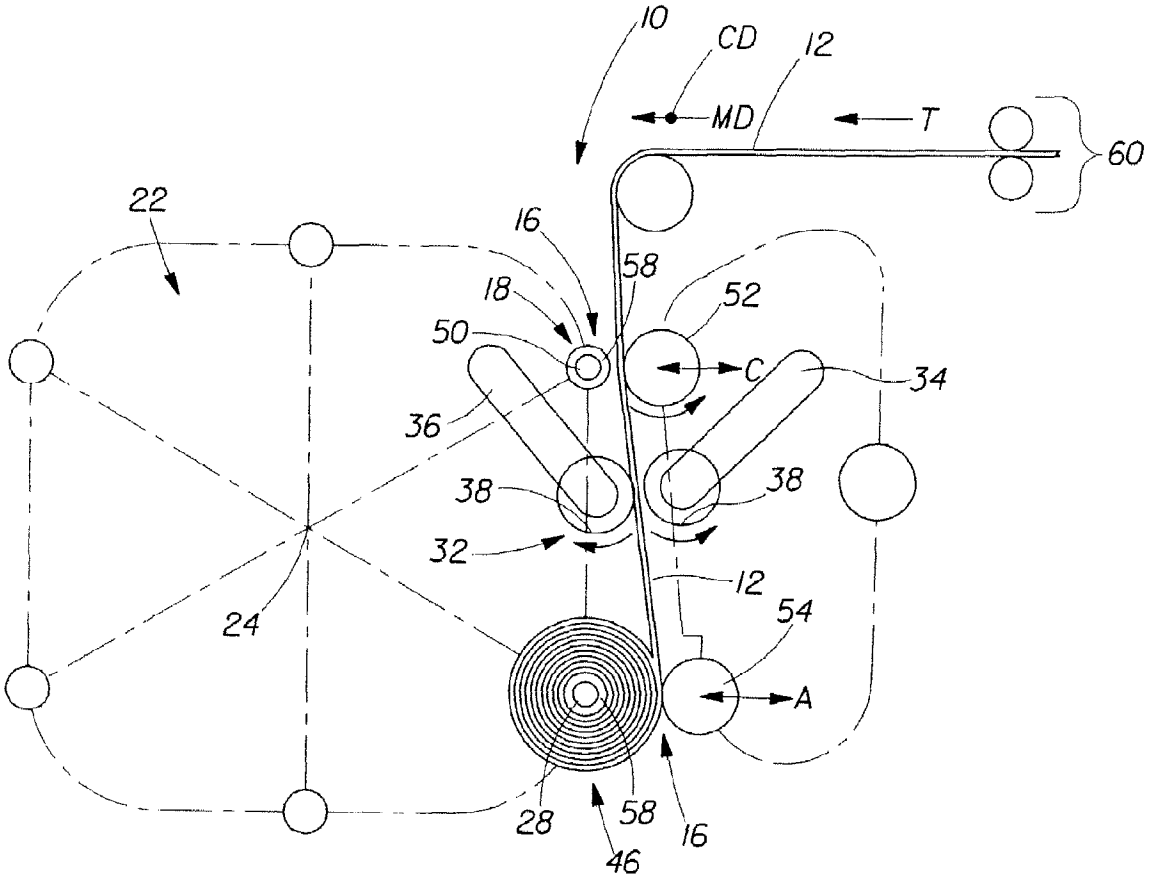

FIG. 6 depicts the winder 10 of the instant invention at approximately 359 machine degrees. In this position, new log 46 is experiencing final radial growth due the continued deposition of web material 12 thereupon. The position of first surface contact roll 54 is adjusted along axis A as required in order to provide the desired contact, or pressure, of first surface contact roll 54 upon new winding log 46 in order to provide the desired wind profile as web material 12 is disposed thereon. Concurrently, third surface contact roll 52 is moved along axis C into contacting engagement with web material 12 and proximate to new winding spindle 18 that will form a second new log 50. Further, the elements 34, 36 and the surfaces 38 disposed thereupon forming web separator 32 are each moved to a position proximate to web material 12 disposed intermediate therebetween in order to facilitate separation of web material 12 at the desired perforation as described supra. In this regard, the movement of the first element 34 and second element 36 comprising web separator 32 are timed such that they form a nip through which web material 12 passes and contact the web material 12 when the perforation at the trailing edge of the last desired sheet of web material 12 to be disposed upon first winding log 46 is located between cooperative rollers 16 comprising second new log 50 and third surface contact roll 52, and the elements 34, 36 comprising web separator 32. In other words, concurrent with the nip formation by the elements 34, 36 comprising web separator 32, the third surface contact roll 52, which is preferably provided with a surface speed equal to the speed of web material 12, forms a nip with the winding spindle 18 forming second new log 50. Thus, the combination of the over-speed nip formed by web separator 32 and the nip formed by cooperative rollers 16 (i.e., winding spindle 18 forming second new log 50 and third surface contact roll 52) causes the perforation located between the two nip points to break resulting in the formation of the first winding log 46 having the desired number of sheets disposed thereon.

In a preferred embodiment, the desired perforation disposed upon web material 12 is positioned within ½-inch (1.27 cm), more preferably with ¼-inch (0.64 cm), and most preferably with ⅛-inch (0.32 cm) on the downstream (relative to the machine direction) side of the nip formed between cooperative elements 16 (i.e., second new log 50 and third surface contact roll 52). This positions the desired perforation between the nip formed between the elements 34,36 comprising web separator 32 and the nip formed between cooperative elements 16. It is believed that this can minimize the portion of the sheet of web material 12 that extends beyond the transfer point onto the winding spindle 18 forming second new log 50. It is believed that this can reduce or eliminate the "fold-back" typically associated with the prior art chop-off/transfer systems. It should be understood that such foldback is typically associated with wrinkles on the core sheet forming finally wound product 14 and are generally perceived as lower quality and can prohibit and/or inhibit consumers from using the first sheet disposed upon a core forming finally wound product 14.

Further, the web separator 32 can be registered with other features present upon, or within, web material 12. This can include registration with embossing, perforations, or other indicia, and the like, in either the machine and/or cross-machine directions. It is believed that this capability can be used to preferentially exert more, or less, contact force in desired areas of the web material 12 corresponding to other product properties. Such operations can be developed, and are more fully intended within the scope of the present invention, to avoid contact on a highly embossed area and may eventually preserve target aesthetics.

In another embodiment, the elements 34, 36 and the tips 38 comprising web separator 32 can be provided with a permeable surface or any other type of surface that provides for the application of a substance from web separator 32 to the web material 12 either continuously (i.e., web separator 32 is in continuous contact with web material 12) or discontinuously (i.e., web separator 32 is in periodic, or non-continuous, contact with web material 12). In such an embodiment, web separator 32 is preferably in fluid communication with a supply of substance sought to be disposed upon web material 12. Alternatively, such a permeable web separator 32 and the elements 34, 36 cooperatively associated thereto, can be in fluid communication with a source of vacuum that facilitates the withdrawal or removal of moisture or debris from the surface of web material 12 passing therebetween. It is believed that one of skill in the art would be able to adapt such a permeable roll to such a vacuum source in order to facilitate such removal of unwanted products, components, constituents, or debris, from the surface of web material 12. Yet still, web separator 32 and the elements 34, 36 can be heated and/or cooled, as would be done one of skill in the art, in order to effectuate the positive benefits by the association of heat and/or cooling to the web material 12 in order to activate or control a desired process either on, or with, web material 12.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for rewinding a web material, said method comprising the steps of:

disposing said web material on a first surface contact roll;

providing at least one winding spindle proximate said material disposed upon said first surface contact roll, said winding spindle being capable of having a surface speed different from a surface speed of said first surface contact roll;

adjusting said first surface contact roll relative to said at least one winding spindle; and, transferring said web material to said at least one winding spindle from said first surface contact roll to produce a finally wound product at the end of a winding cycle, wherein said first surface contact roll maintains contact with said web material throughout the entirety of the winding cycle.

2. The method according to claim 1 further comprising the step of operatively associating said winding spindle with a winding turret.

3. The method according to claim 2 further comprising the step of operatively associating a plurality of winding spindles with said winding turret.

4. The method according to claim 3 further comprising the step of sequentially positioning each of said plurality of winding spindles proximate to said web material disposed upon said first surface contact roll and transferring said web material to each of said winding spindles.

5. The method according to claim 1 further comprising the step of indexing said winding spindle from a first winding position proximate said first surface contact roll to a second winding position proximate said first surface contact roll.

6. The method according to claim 1 further comprising the step of disposing a core about said winding spindle and transferring said web material to said core when said winding spindle is proximate said first surface contact roll and said web material disposed thereon.

7. The method according to claim 1 further comprising the step of providing a plurality of first surface contact rolls.

8. The method according to claim 7 wherein said step of adjusting said first surface contact roll relative to said at least one winding spindle further comprises the step of moving at least one of said plurality of first surface contact rolls relative to said winding spindle.

9. The method according to claim 8 wherein said at least one of said plurality of first surface contact rolls changes a pressure exerted upon said web material by said first surface contact roll when said web material is disposed between said first surface contact roll and said winding spindle.

10. The method according to claim 1 further comprising the step of perforating said web material.

11. The method according to claim 1 further comprising the step of providing a web separator, said web separator being adapted to periodically pinch said web material between web separator and said first surface contact roll.

12. The method according to claim 11 further comprising the step of providing said first surface contact roll with a low coefficient of friction.

13. The method according to claim 11 further comprising the step of providing said web separator with a surface speed that is greater than a surface speed of said first surface contact roll.

14. A method for winding web material, said method comprising the steps of:

providing a first surface contact roll, said first surface contact roll having a surface and a first surface speed;

transferring said web material to said surface of said first surface contact roll;

adjusting said first surface contact roll relative to a first winding spindle, said first winding spindle having a second surface speed, wherein said second surface speed can be different from said first surface speed;

subsequently transferring said web material from said surface of said first surface contact roll to said first winding spindle;

disposing said web material upon said first winding spindle to produce a finally wound product at the end of a winding cycle; and, maintaining said first surface contact roll in contacting engagement with said web material throughout the entirety of the winding cycle.

15. A method according to claim 14 further comprising the step of perforating said web material.

16. A method according to claim 15 further comprising the step of separating said web material at a perforation separating adjoining pieces of said web material.

17. A method according to claim 16 wherein said step of separating said web material further comprises the step of providing a separation device for separating said web material, said separation device having a surface speed that is faster than a speed of said web material.

18. A method according to claim 14 further comprising the step of progressing said first winding spindle from a first winding position to a second winding position when said web material is being disposed upon said first winding spindle.

19. A method according to claim 14 further comprising the step of cooperatively associating said first winding spindle with a winding turret.

20. A method for converting a web material into a wound roll, the method comprising the step of:

depositing said web material onto a first surface contact roll;

moving said web material deposited upon said first surface contact roll proximate to a winding spindle;

adjusting said first surface contact roll relative to said winding spindle to provide a desired contact force upon said winding spindle;

rotating said winding spindle;

transferring said web material from said first surface contact roll to said winding spindle to produce a finally wound product at the end of a winding cycle, said contact force being adjustable during said winding cycle; and, engaging said first surface contact roll with said web material throughout the entirety of the winding cycle.

* * * * *